US009373466B2

(12) United States Patent
Sasaki et al.

(10) Patent No.: US 9,373,466 B2
(45) Date of Patent: Jun. 21, 2016

(54) SWITCHING DEVICE

(71) Applicant: ALPS ELECTRIC CO., LTD., Tokyo (JP)

(72) Inventors: Makoto Sasaki, Miyagi-Ken (JP); Tomoaki Tsuchiya, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 115 days.

(21) Appl. No.: 14/253,430

(22) Filed: Apr. 15, 2014

(65) Prior Publication Data

US 2014/0346019 A1 Nov. 27, 2014

(30) Foreign Application Priority Data

May 24, 2013 (JP) ..... 2013-109485

(51) Int. Cl.

| | |
|---|---|
| ***H01H 1/00*** | (2006.01) |
| ***H01H 23/06*** | (2006.01) |
| ***H01H 23/16*** | (2006.01) |
| ***H01H 23/20*** | (2006.01) |

(52) U.S. Cl.

CPC ..... *H01H 23/06* (2013.01); *H01H 23/168* (2013.01); *H01H 23/20* (2013.01)

(58) Field of Classification Search

CPC ..... H01H 23/06; H01H 23/168; H01H 23/20
USPC ..... 200/293, 303, 339, 553, 557, 558
See application file for complete search history.

(56) References Cited

U.S. PATENT DOCUMENTS 6,800,825 B1 * 10/2004 Sasaki ..... H01H 21/24 200/339
6,838,630 B2 * 1/2005 Sasaki ..... H01H 23/168 200/18
6,841,750 B2 * 1/2005 Sasaki ..... H01H 23/162 200/339
6,841,751 B2 * 1/2005 Sasaki ..... H01H 23/168 200/5 R
6,888,080 B2 * 5/2005 Sasaki ..... H01H 23/16 200/315
6,903,293 B2 6/2005 Sasaki

FOREIGN PATENT DOCUMENTS

JP 2005-123135 A 5/2005

* cited by examiner

*Primary Examiner* — Renee Luebke
*Assistant Examiner* — Lheiren Mae A Caroc
(74) *Attorney, Agent, or Firm* — Brinks Gilson & Lione

(57) ABSTRACT

An inner wall for partitioning a storage chamber is disposed in a case. A switching member operating a movable contact inside the storage chamber is positioned inside a penetrating portion formed between an inner recess formed on an inner wall and a first cutout portion formed in an inner clamping piece of a lid body. The switching member is formed integrally with a flange portion, and the flange portion closes the penetrating portion. As a result, dust, dirt and moistures are unlikely to enter the storage chamber through the penetrating portion.

6 Claims, 9 Drawing Sheets

SWITCHING DEVICE

CLAIM OF PRIORITY

This application claims benefit of priority to Japanese Patent Application No. 2013-109485 filed on May 24, 2013, which is hereby incorporated by reference in its entirety.

BACKGROUND

1. Field of the Disclosure

The present disclosure relates to a dual type switching device used in vehicle electric equipment, and particularly to a switching device having a structure in which dustproof performance is improved.

2. Description of the Related Art

Dual type switching devices have been used in drive switches for vehicle power window devices and switch units for other vehicle electric equipment.

A switching device disclosed in Japanese Unexamined Patent Application Publication No. 2005-123135 has two contact storage spaces in a case. Each of the contact storage spaces stores a fixed contact member fixed to a bottom, a conductive plate serving as a movable contact, a sliding operation portion of a driver, and a leaf spring for pressing the sliding operation portion against the movable contact.

The case has a slit between inside partition walls of the respective contact storage spaces. The partition wall has a recess, which allows the contact storage space and the slit to communicate with each other. Each of the drivers has the sliding operation portion and a pressed portion. A portion of the driver is positioned inside the recess and the pressed portion is positioned inside the slit.

In Japanese Unexamined Patent Application Publication No. 2005-123135, a cover member formed to have a leaf spring material is mounted on the case. Two contact storage spaces and the slit formed between the adjacent contact storage spaces are covered with one cover member. The pressed portion formed in each of two drivers is positioned in the slit. Two pressed portions protrude upward from a window hole formed in the cover member.

In the electric equipment using the switching device disclosed in Japanese Unexamined Patent Application Publication No. 2005-123135, a working end of an operation knob is interposed between two pressed portions protruding upward from the cover member. If the operation knob is tilted to one side, one driver is pivotally moved, and contact between the fixed contact member and the conductive plate inside one contact storage space is switched. If the operation knob is tilted to the other side, the other driver is pivotally moved, and contact between the fixed contact member and the conductive plate inside the other contact storage space is switched.

In the switching device disclosed in Japanese Unexamined Patent Application Publication No. 2005-123135, each contact storage space and the slit, which are formed in the case, communicate with each other via the recess. The driver is supported to be pivotally movable and vertically movable in the recess. Accordingly, a large gap is formed between an inner edge of the recess and the driver, thereby causing insufficient sealing in each of the contact storage spaces.

In addition, in the switching device disclosed in Japanese Unexamined Patent Application Publication No. 2005-123135, one leaf spring member is disposed across two contact storage spaces and the slit. For this reason, it is necessary to form a cutout portion for passing the leaf spring member on the partition wall. This also causes the insufficient sealing in the contact storage space.

Furthermore, above the slit, the window hole is formed in the cover member, and a pressed portion of the driver protrudes upward from the window hole. However, in order for the driver to be pivotally moved, it is necessary to form a large gap between the window hole and the pressed portion.

As a result, dust, dirt and moistures are likely to enter the slit through the window hole of the cover member. Furthermore, the dust, or the like, is likely to break into the contact storage space from the inside of the slit via the recess. Therefore, there is a problem because this degrades reliability in switching the contacts.

SUMMARY

According to an aspect, there is provided a switching device including a case for storing a fixed contact, a movable contact selectively coming into contact with the fixed contact and a switching member operating the movable contact; and a lid body for closing the case.

The case is formed to integrally have two inner walls erecting from a bottom and opposing each other, two outer walls opposing an outside of the respective inner walls and erecting from the bottom, and a side wall connecting both ends of the respective inner walls and the respective outer walls and erecting from the bottom. The case is configured to have two storage chambers having an upper opening by being surrounded with the inner walls, the outer walls, the side wall and the bottom, and an operation space positioned between two inner walls. Each of the storage chambers stores the fixed contact and the movable contact.

Each of the storage chambers has an inner recess, which is exposed upward by penetrating the inner wall.

Each of the switching members has a tip support portion supported by the outer wall, a base support portion supported by the inner recess, a drive portion positioned inside the storage chamber and operating the movable contact, and an operation portion formed integrally with the base support portion and moving inside the operation space.

Each of the storage chambers stores a spring member pressing the drive portion against the movable contact and biasing the operation portion so as to return to an initial posture. The lid body is separated into two, and the opening of the storage chamber is closed by each of the lid bodies. The lid body has clamping pieces overlapped with each other on an outer surface facing the operation space of the inner wall, and the switching member is positioned in a cutout portion formed in the clamping piece.

In the switching device of the present invention, two storage chambers are formed in the case and the upper opening of the respective storage chambers is covered with the individual lid body. The clamping piece is formed integrally with the lid body, and the clamping piece and the inner wall are overlapped with each other. The minimum penetrating portion required for operating the switching member is formed between the inner recess formed on the inner wall and the cutout portion formed in the clamping piece. Therefore, it is possible to improve a sealing degree in the storage chamber.

According to a switching device of the present invention, it is possible to improve a sealing degree of two storage chambers formed in a case. Therefore, dust, dirt or moistures are unlikely to enter a contact portion of contacts.

DESCRIPTION OF THE EXEMPLARY EMBODIMENTS

Figure 1:
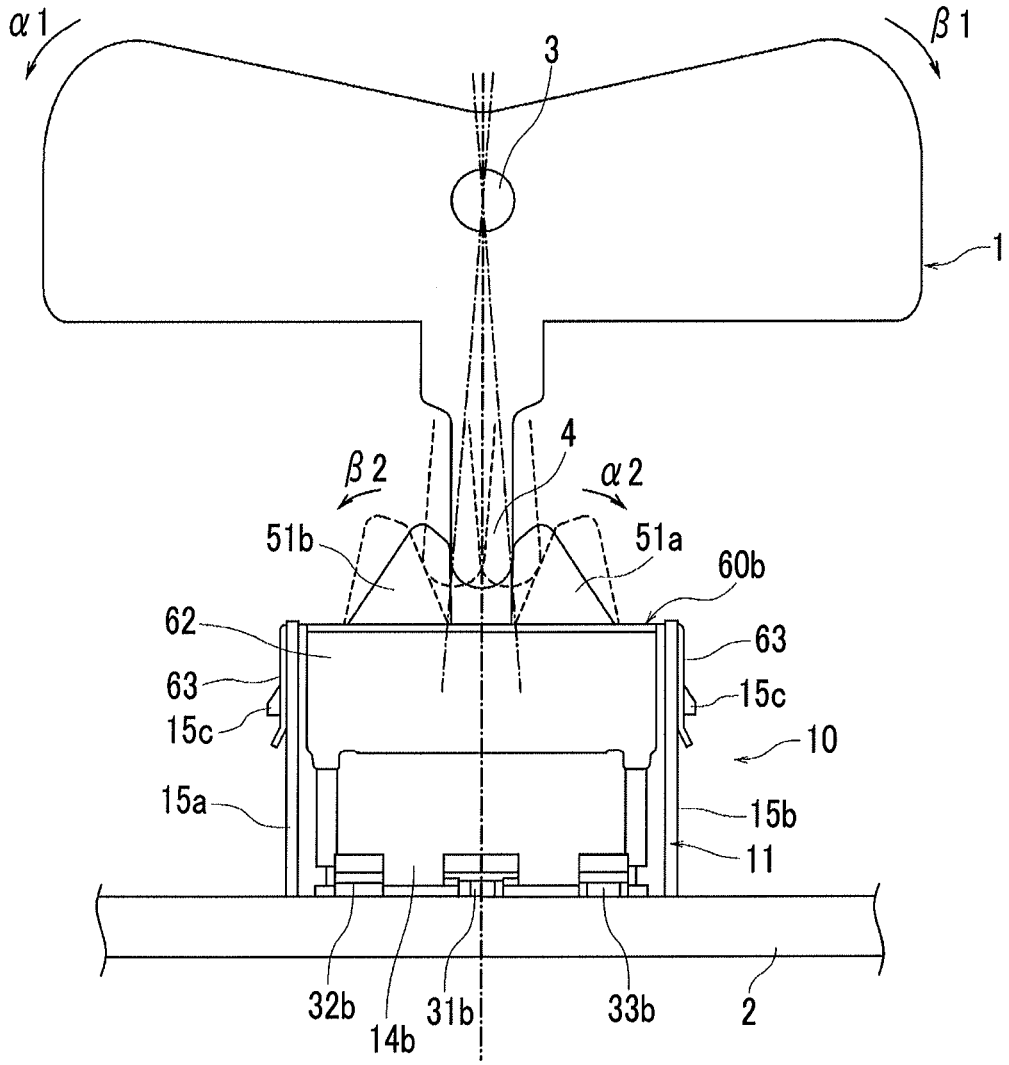
FIG. 1 is a front view illustrating a structure in which a switching device and an operation member according to an embodiment of the present invention are combined with each other.

FIG. 1 illustrates a structure in which a switching device 10 and an operation member 1 according to an embodiment of the present invention are combined with each other. The operation member 1 is used in opening and closing operations for a vehicle power window device. The switching device 10 can be used as a detection switch or a changeover switch for various electric equipment facilities in addition to the vehicle power window device.

Figure 2:
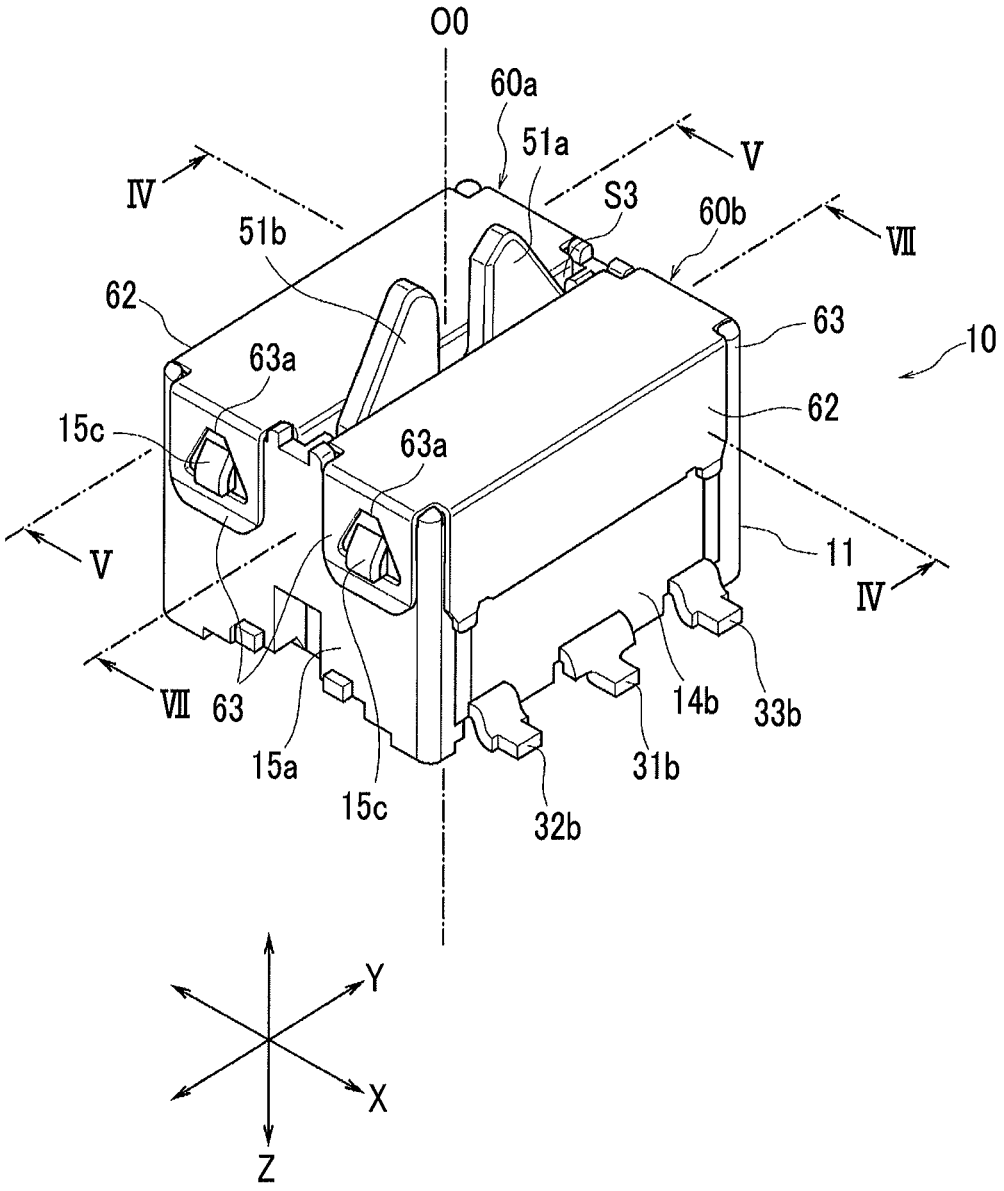
FIG. 2 is a perspective view of a switching device according to an embodiment of the present invention.

In the switching device 10 illustrated in FIG. 2 and the subsequent drawings, an X direction represents a back and forth direction, a Y direction represents a lateral direction and a Z direction represents a vertical direction.

The switching device 10 has a case 11. The case 11 is injection-molded by using a synthetic insulating resin.

Figure 3:
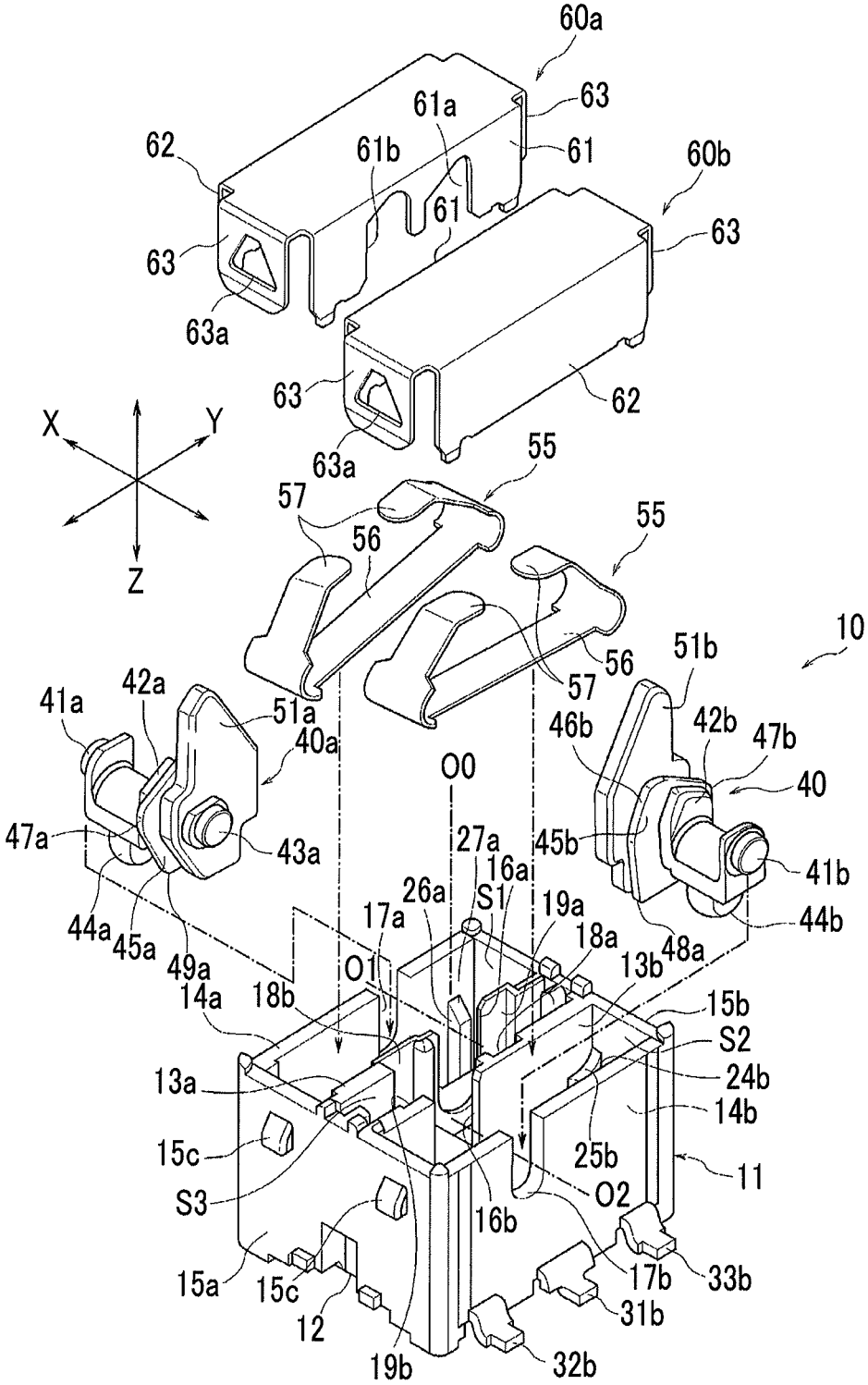
FIG. 3 is an exploded perspective view of the switching device illustrated in FIG. 2.
Figure 4:
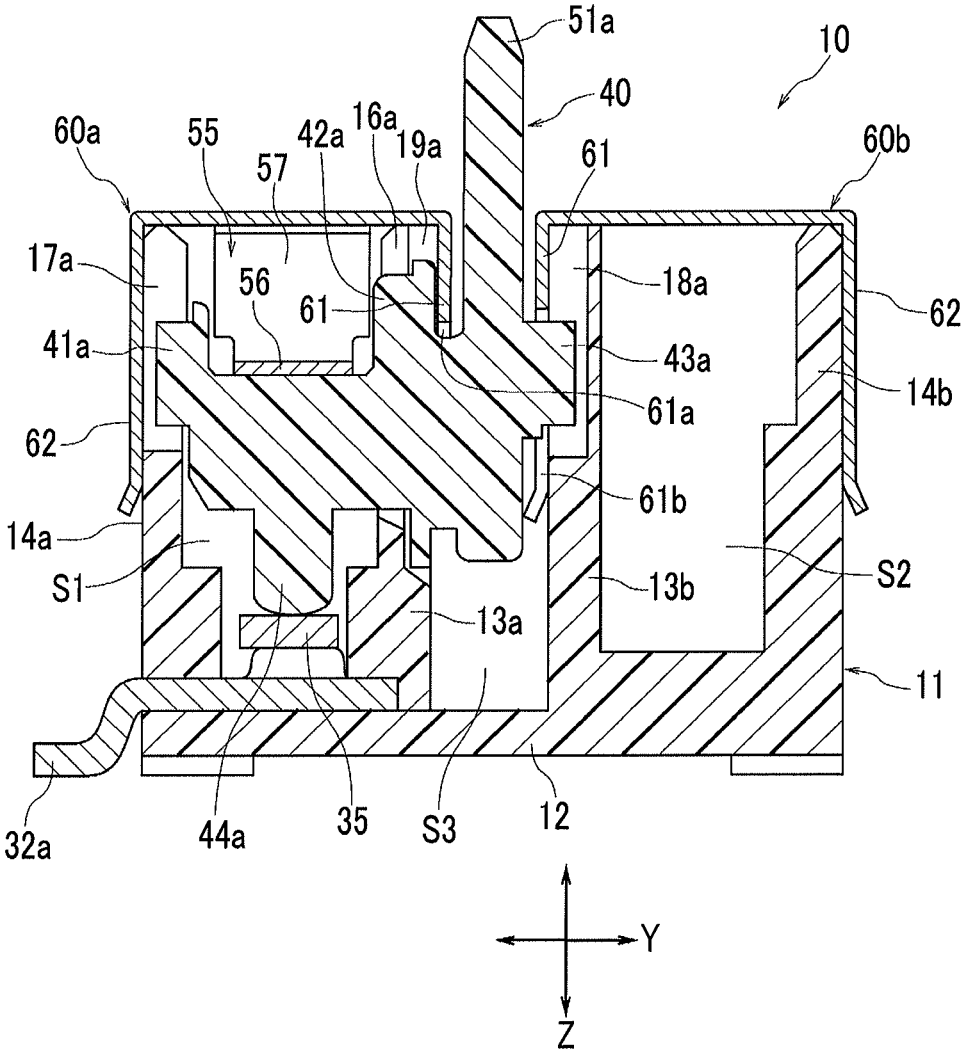
FIG. 4 is a cross-sectional view taken along line IV-IV in the switching device illustrated in FIG. 2.
Figure 5:
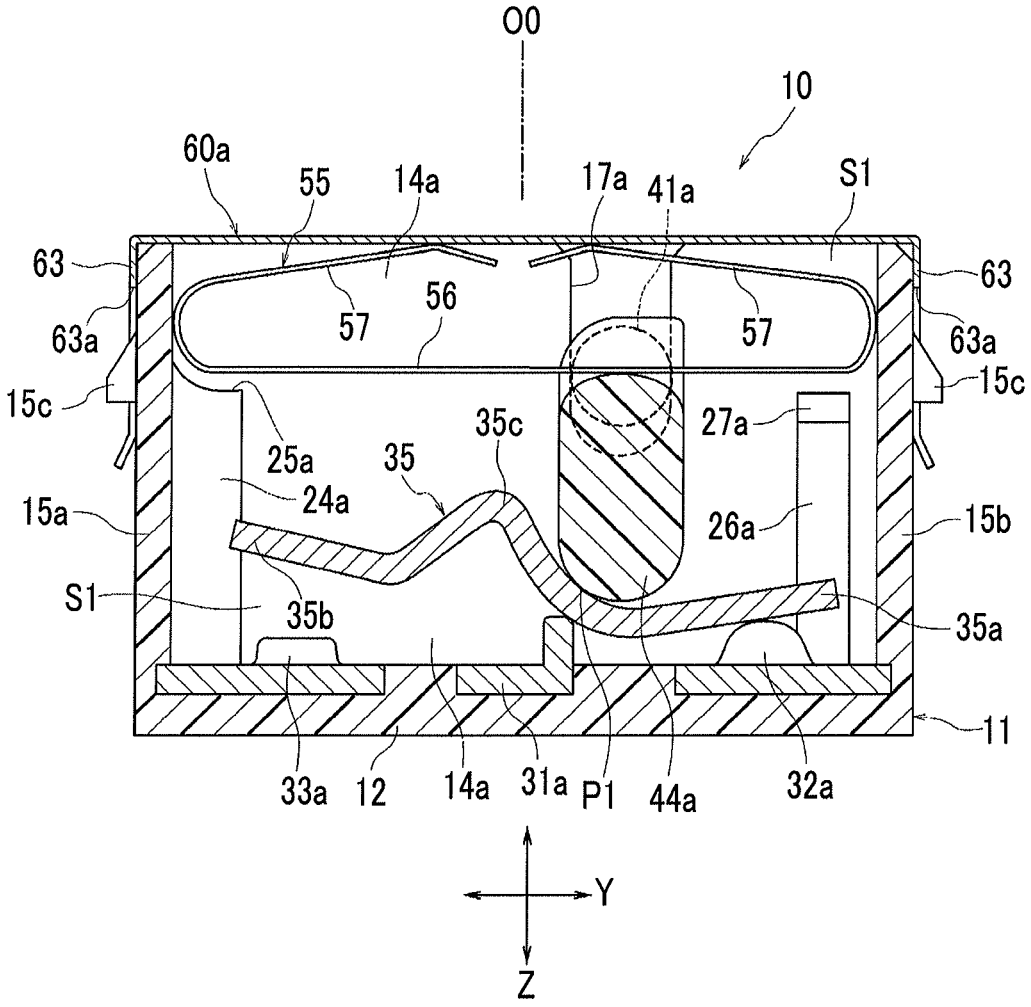
FIG. 5 is a cross-sectional view taken along line V-V in the switching device illustrated in FIG. 2.

As illustrated in FIGS. 4 and 5, the case 11 has a bottom 12. As illustrated in FIG. 3, the case 11 is formed to integrally have a first inner wall 13*a* and a second inner wall 13*b* which vertically erect from the bottom 12, a first outer wall 14*a*, a second outer wall 14*b*, and side walls 15*a* and 15*b*.

The first inner wall 13*a* and the second inner wall 13*b* oppose each other in the back and forth direction (X direction), the first outer wall 14*a* opposes the outer side in the back and forth direction of the first inner wall 13*a*, and the second outer wall 14*b* opposes the outer side in the back and forth direction of the second inner wall 13*b*. The side walls 15*a* and 15*b* are formed in a direction orthogonal to the inner wall and the outer wall and oppose each other by leaving a distance in the lateral direction (Y direction).

The case 11 has a first storage chamber S1 which is surrounded with the first inner wall 13*a*, the first outer wall 14*a* and the side walls 15*a* and 15*b*, and whose lower section is closed by the bottom 12. A second storage chamber S2 whose lower section is closed by the bottom 12 is formed by being surrounded with the second inner wall 13*b*, the second outer wall 14*b* and the side walls 15*a* and 15*b*. The first storage chamber S1 and the second storage chamber S2 serve as openings, which are exposed upward together.

The case 11 has an operation space S3 between the first inner wall 13*a* and the second inner wall 13*b*. The operation space S3 is an elongated space extending in the lateral direction (Y direction). In the embodiment illustrated in FIGS. 2 and 3, both side portions in the lateral direction of the operation space S3 are closed by the side walls 15*a* and 15*b*. However, the operation space S3 may not be closed by the side walls 15*a* and 15*b*, and may be exposed in the lateral direction (Y direction).

FIGS. 2 and 3 illustrate a case center line O0 perpendicularly extending from a center of the bottom 12 in the vertical direction (Z direction). The case 11 is coincident with a shape obtained by rotating the case 11 by 180 degrees around the case center line O0. That is, a structure and dimensions of the first storage chamber S1 and the second storage chamber S2, and a structure and dimensions of the operation space S3 are rotationally symmetrical by 180 degrees with respect to the case center line O0.

As illustrated in FIG. 3, the first inner recess 16*a* is formed on the first inner wall 13*a*, and the first outer recess 17*a* is formed on the first outer wall 14*a*. The second inner recess 16*b* is formed on the second inner wall 13*b*, and the second outer recess 17*b* is formed on the second outer wall 14*b*. The first outer recess 17*a* functions as a first outer support portion, and the second outer recess 17 functions as a second outer support portion.

The first inner recess 16*a* penetrates the first inner wall 13*a* in the back and forth direction (X direction), the second inner recess 16*b* penetrates the second inner wall 13*b* in the back and forth direction (X direction), and the first inner recess 16*a* and the second inner recess 16*b* are exposed upward. The first outer recess 17*a* and the second outer recess 17*b* are exposed upward. In FIG. 3, the first outer recess 17*a* penetrates the first outer wall 14*a* in the back and forth direction (X direction). However, the first outer recess 17*a* may not penetrate the first outer wall 14*a*, and the first outer recess 17*a* may have a groove shape extending in the vertical direction by forming a step on an inner surface facing the first storage chamber S1. This configuration is similarly applied to the second outer recess 17*b*.

As illustrated in FIG. 3, a line connecting the center in the width direction of the first inner recess 16*a* and the center in the width direction of the first outer recess 17*a* represents a first support reference line O1, and a line connecting the center in the width direction of the second inner recess 16*b* and the center in the width direction of the second outer recess 17*b* represents a second support reference line O2. The first support reference line O1 is positioned closer to the side wall 15*b* than the case center line O0, and the second support reference line O2 is positioned closer to the side wall 15*a* than the case center line O0.

As illustrated in FIG. 3, a first auxiliary recess 18*a* is formed on an outer surface facing the operation space S3 of the second inner wall 13*b*. The first auxiliary recess 18*a* has a groove shape formed without penetrating the second inner wall 13*b* in the back and forth direction (X direction), and is exposed upward. The center in the width direction of the first auxiliary recess 18*a* is positioned on the first support reference line O1. A second auxiliary recess 18*b* is formed in a groove shape exposed upward on an outer surface facing the operation space S3 of the first inner wall 13*a*. The center in the width direction of the second auxiliary recess 18*b* is positioned on the second support reference line O2.

Figure 9:
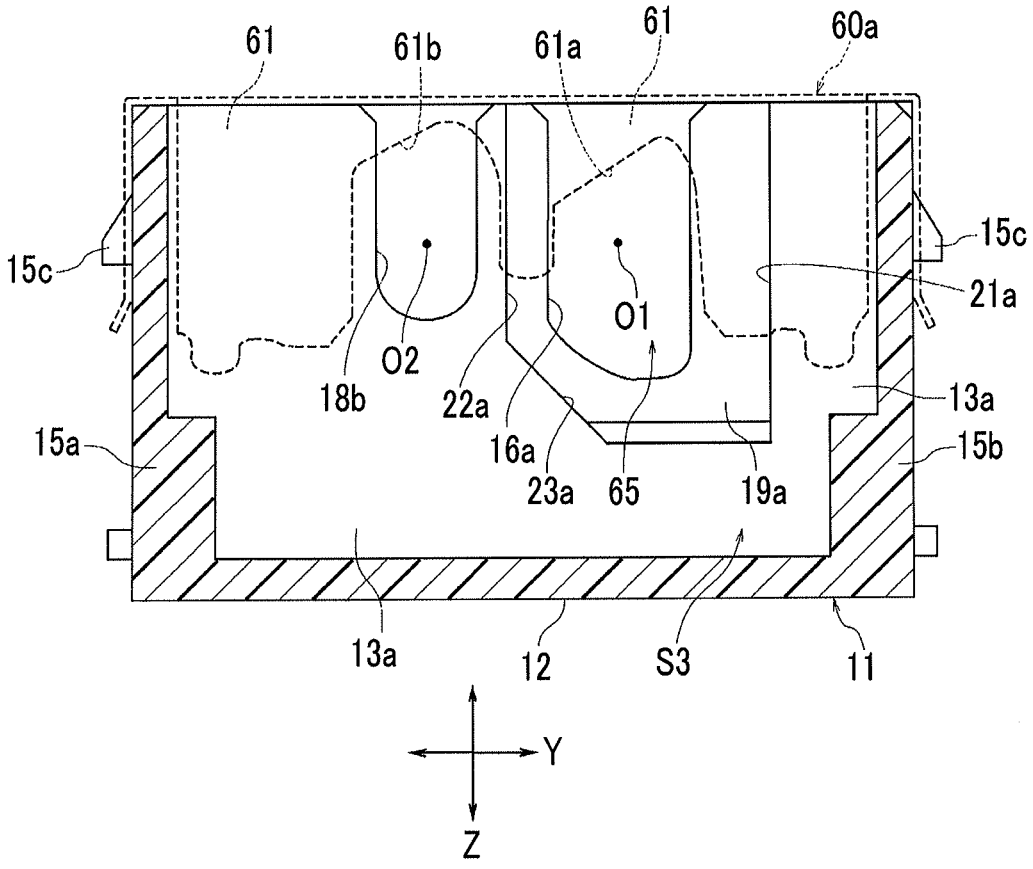
FIG. 9 is a cross-sectional view illustrating a configuration of a penetrating portion in the cross-sectional view which is the same as that of FIG. 7.

FIG. 9 illustrates the case 11, which appears in the cross section taken along line VII-VII illustrated in FIG. 2. In FIG. 9, the cross section of the bottom 12 and the side walls 15*a* and 15*b* of the case 11 appears, and the outer surface facing the operation space S3 of the first inner wall 13*a* appears.

As illustrated in FIG. 9, in the first inner wall 13*a*, a first wall surface dent 19*a* is formed on both sides and the lower side in the width direction of the first inner recess 16*a*. As illustrated in FIG. 3, the first wall surface dent 19*a* is formed so as to be dented from the outer surface facing the operation space S3 toward an intermediate portion in a thickness direction of the first inner wall. As illustrated in FIG. 3, in the outer surface facing the operation space S3 of the second inner wall 13*b*, a second wall surface dent 19*b* is also formed across both sides and the lower side in the width direction of the second inner recess 16*b*.

As illustrated in FIG. 9, the first wall surface dent 19*a* is formed to have a vertical edge inner surface 21*a* extending in parallel with the nearest side wall 15*b*, a vertical edge inner surface 22*a* extending in parallel with the vertical edge inner surface 21*a*, and an inclination edge inner surface 23*a* which is continuous with the lower side of the vertical edge inner surface 22*a* and is inclined to the vertical edge inner surface 22*a*.

FIG. 5 is a cross-sectional view taken along line V-V in FIG. 2 and illustrates an internal structure of the first storage chamber S1. In FIG. 5, the inner surface facing the first storage chamber S1 of the first outer wall 14*a* appears. A protruding portion 24*a* vertically extending near the side wall 15*a* is formed on the inner surface of the first outer wall 14*a*, and an upper end surface thereof serves as a spring regulating portion 25*a* having a concavely curved surface shape. As also illustrated in FIG. 3, a protruding portion 26*a* vertically extending near the side wall 15*b* is formed on the inner surface of the first outer wall 14*a*, and an upper end surface thereof serves as a spring regulating portion 27*a*. The protruding portion 24*a*, the spring regulating portion 25*a*, the protruding portion 26*a* and the spring regulating portion 27*a* are formed to be also plane-symmetrical to the inner surface facing the first storage chamber S1 of the first inner wall 13*a*.

An internal structure of the second storage chamber S2 and an internal structure of the first storage chamber S1 are rotationally symmetrical with respect to the case center line O0. Therefore, the inner surface of the second inner wall 13*b* and the inner surface of the second outer wall 14*b* also respectively have a protruding portion 24*b* and a spring regulating portion 25*b*, and a protruding portion 26*b* and a spring regulating portion 27*b*. The protruding portion 24*b* and the spring regulating portion 25*b* appear in FIG. 3, but the protruding portion 26*b* and the spring regulating portion 27*b* do not appear in FIG. 3.

As illustrated in FIG. 5, three fixed contacts are fixedly disposed on bottom 12 in the first storage chamber S1. A common fixed contact 31*a* is fixed to a center in the lateral direction (Y direction), an initial contact fixed contact 32*a* is fixed to a side close to the side wall 15*b*, and a switching fixed contact 33*a* is fixed to a side close to the side wall 15*a*.

The second storage chamber S2 and the first storage chamber S1 have a rotationally symmetrical shape (rotationally symmetrical structure) around the case center line O0. Accordingly, as illustrated in FIGS. 2 and 3, in the second storage chamber S2, a common fixed contact 31*b* is fixed to the center, an initial contact fixed contact 32*b* is fixed to a side close to the side wall 15*a*, and a switching fixed contact 32*c* is fixed to a side close to the side wall 15*b*.

As illustrated in FIG. 5, a movable contact 35 is stored in the first storage chamber S1. The movable contact 35 is formed of a conductive plate material such as a copper plate. The movable contact 35 stored in the first storage chamber S1 has an initial contact piece 35*a* corresponding to the initial contact fixed contact 32*a* and a switching contact piece 35*b* corresponding to the switching fixed contact 33*a*, and in an intermediate portion therebetween, a ride-on portion 35*c* is formed to protrude upward. The ride-on portion 35*c* is formed closer to the switching fixed contact 33*a* than the common fixed contact 31*a*.

The second storage chamber S2 also stores the movable contact 35 similar to the first storage chamber S1. The movable contact 35 stored in the second storage chamber S2 is arranged so as to have an orientation in the lateral direction (Y direction) which is opposite to that of the movable contact 35 stored in the first storage chamber S1. The movable contact 35 stored in the second storage chamber S2 is configured so that the initial contact piece 35*a* is directed to the side wall 15*a* and the switching contact piece 35*b* is directed to the side wall 15*b*.

As illustrated in FIG. 3, a first switching member 40*a* is stored in the first storage chamber S1 of the case 11, and a second switching member 40*b* is stored in the second storage chamber S2. The first switching member 40*a* and the second switching member 40*b* are formed of a synthetic resin material, have the same structure and dimensions as each other, but assembled postures in the case 11 are rotationally symmetrical by 180 degrees with respect to the case center line O0. Therefore, in the following description, the first switching member 40*a* and the second switching member 40*b* will be described with reference to different reference numerals.

As illustrated in FIGS. 3 and 4, the first switching member 40*a* has a tip support portion 41*a* directed to one side in the back and forth direction (X direction), an auxiliary support portion 43*a* directed in the opposite direction, and a base support portion 42*a* positioned in the middle. The tip support portion 41*a* and the auxiliary support portion 43*a* have a short circular shaft shape in cross section. A drive portion 44*a* is formed to face downward between the tip support portion 41*a* and the base support portion 42*a*.

Figure 7:
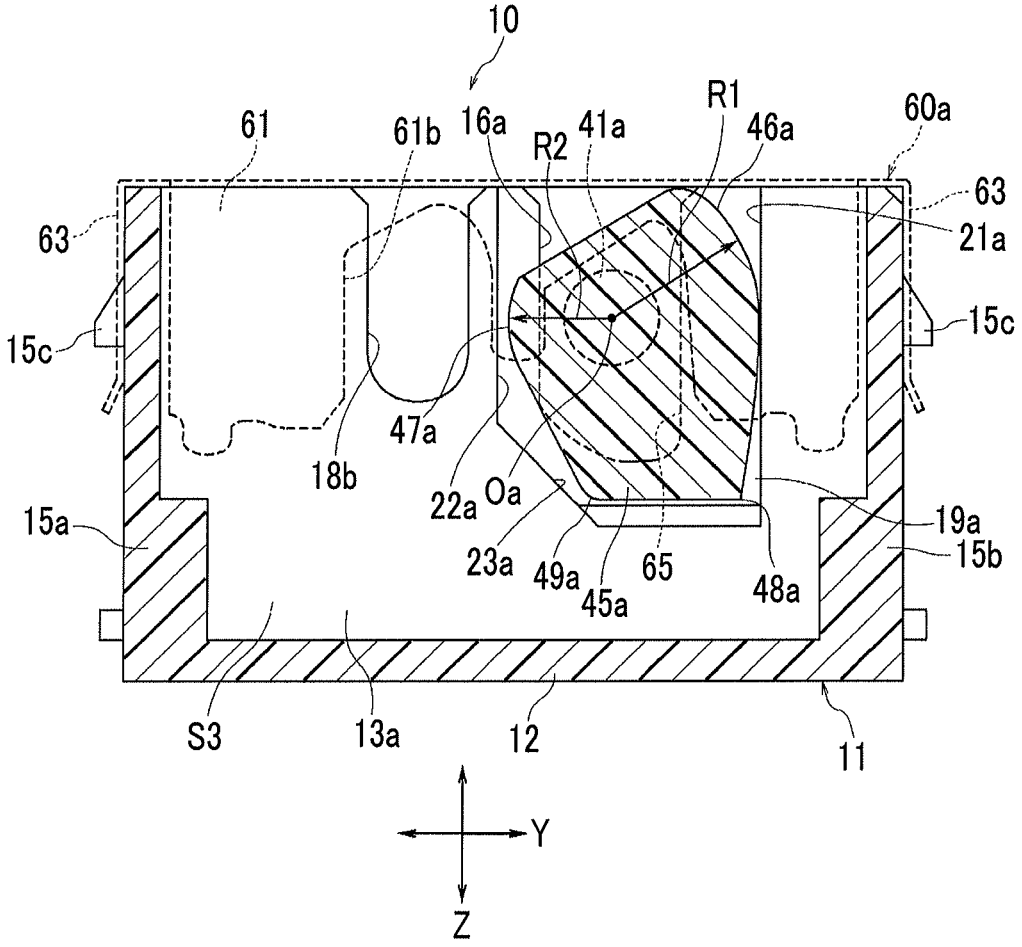
FIG. 7 is a cross-sectional view taken along line VII-VII in the switching device illustrated in FIG. 2.

In the first switching member 40*a*, a flange portion 45*a* and an operation portion 51*a* are formed integrally with each other between the base support portion 42*a* and the auxiliary support portion 43*a*. FIG. 7 is a cross-sectional view taken along line VII-VII in FIG. 2, and a cross-sectional shape of the flange portion 45*a* is illustrated here.

A convexly curved surface portion 46*a* and a convexly curved surface portion 47*a* are disposed on an edge outer surface of the flange portion 45*a*. FIG. 7 illustrates a pivotal movement center line Oa connecting an axial center of the tip support portion 41*a* and the auxiliary support portion 43*a*. One convexly curved surface portion 46*a* is formed along a locus of a radius R1 centered on the pivotal movement center line Oa, and the other convexly curved surface portion 47*a* is formed along the regulation of a radius R2 centered on the pivotal movement center line Oa. The radius R1 is larger than the radius R2.

In addition, on the edge outer surface of the flange portion 45*a*, a pivotal movement regulating portion 48*a* is formed at a corner below the convexly curved surface portion 46*a*, and a pivotal movement regulating portion 49*a* is formed at a corner below the convexly curved surface portion 47*a*.

The operation portion 51*a* of the first switching member 40*a* protrudes upward.

Similarly, the second switching member 40*b* has a tip support portion 41*b*, a base support portion 42*b*, an auxiliary support portion 43*b*, a drive portion 44*b*, a flange portion 45*b* and an operation portion 51*b*. Convexly curved surface portions 46*a* and 47*b* and pivotal movement regulating portions 48*b* and 49*b* are disposed in the flange portion 45*b*. In FIG. 3, the auxiliary support portion 43*b* and the pivotal movement regulating portion 49*b* do not appear.

As illustrated in FIG. 3, spring members 55 having the same structure and dimensions are respectively mounted from above on the first storage chamber S1 and the second storage chamber S2. Each of the spring members 55 is formed of a leaf spring material, and is configured so that an elastic pressing piece 56 and elastic support pieces 57 and 57, which are bent upward from an end portion in the lateral direction of the elastic pressing piece 56, are formed integrally with one another.

As illustrated in FIGS. 3 and 4, the upper opening of the first storage chamber S1 is closed by a first lid body 60*a*, and the upper opening of the second storage chamber S2 is closed by a second lid body 60*b*. The first lid body 60*a* and the second lid body 60*b* have the same structure and dimensions, but are used in a rotationally symmetrical direction centered on the case center line O0.

As illustrated in FIG. 3, the first lid body 60*a* and the second lid body 60*b* are formed by bending a leaf spring material. An inner clamping piece 61 and an outer clamping piece 62 are bent downward at a substantially right angle in the respective lid bodies 60*a* and 60*b*. The inner clamping piece 61 and the outer clamping piece 62 oppose each other by leaving a distance in the back and forth direction (X direction). A first cutout portion 61*a* and a second cutout portion 61*b*, which are exposed downward, are formed side by side in the inner clamping piece 61.

In the respective lid bodies 60*a* and 60*b*, side portion clamping pieces 63 and 63 which oppose each other in the lateral direction (Y direction) are bent. Hooking holes 63*a* and 63*a* are respectively opened on each of the side portion clamping pieces 63 and 63.

As illustrated in FIG. 3, hooking projections 15*c* and 15*c* which oppose the corresponding hooking holes 63*a* and 63*a* are integrally formed on the outer surface of the side walls 15*a* and 15*b* of the case 11.

The switching device 10 configured to have the above-described members is assembled as follows.

After the movable contacts 35 and 35 are respectively inserted into the first storage chamber S1 and the second storage chamber S2, the first switching member 40*a* and the second switching member 40*b* are mounted from above on the case 11 so as to face downward. FIG. 4 illustrates a state where the first switching member 40*a* is mounted on the case 11.

The tip support portion 41*a* of the first switching member 40*a* is inserted from above into the first outer recess 17*a* formed on the first outer wall 14*a*, the base support portion 42*a* is inserted from above into the first inner recess 16*a* formed on the first inner wall 13*a*, and the auxiliary support portion 43*a* is inserted from above into the first auxiliary recess 18*a* formed on the second inner wall 13*b*. The flange portion 45*a* is inserted into the first wall surface dent 19*a* formed on the first inner wall 13*a*.

The drive portion 44*a* is inserted into the first storage chamber S1, and the operation portion 51*a* is positioned inside the operation space S3 of the case 11.

Similarly, in a case of the second switching member 40*b*, the tip support portion 41*b* is inserted from above into the second outer recess 17*b*, the auxiliary support portion 43*b* (not illustrated) is inserted from above into the second auxiliary recess 18*b*, and the base support portion 42*b* is inserted from above into the second inner recess 16*b*. The flange portion 45*b* is inserted from above into the second wall surface dent 19*b*. The drive portion 44*b* is stored inside the second storage chamber S2, and the operation portion 51*b* is arranged inside the operation space S3.

After the movable contacts 35 is mounted, the first switching member 40*a* and the second switching member 40*b* are respectively mounted on each of the first storage chamber S1 and the second storage chamber S2 of the case 11, and the spring members 55 and 55 are respectively inserted into the first storage chamber S1 and the second storage chamber S2.

Then, the first lid body 60*a* is mounted on the upper opening of the first storage chamber S1, and the second lid body 60*b* is mounted on the upper opening of the second storage chamber S2.

As illustrated in FIG. 4, the inner clamping piece 61 of the first lid body 60*a* is elastically pressed against the outer surface facing the operation space S3 of the first inner wall 13*a* of the case 11, and the outer clamping piece 62 is elastically pressed against the outer surface of the first outer wall 14*a*. As illustrated in FIG. 5, the side portion clamping pieces 63 and 63 are respectively mounted on the outer surface of the side walls 15*a* and 15*a*. The hooking holes 63*a* and 63*a* formed in each of the side portion clamping pieces 63 and 63 are respectively hooked on the hooking projections 15*c* and 15*c* formed on each of the side walls 15*a* and 15*b*, thereby fixing the first lid body 60*a*.

Similarly, the inner clamping piece 61 of the second lid body 60*b* is elastically pressed against the outer surface of the second inner wall 13*b*, and the outer clamping piece 62 is elastically pressed against the outer surface of the second outer wall 14*b*. In addition, the side portion clamping pieces 63 and 63 are respectively and elastically pressed against each outer surface of the side walls 15*a* and 15*b*, and the hooking holes 63*a* and 63*a* are respectively hooked on the hooking projections 15*c* and 15*c*.

The first outer recess 17*a* formed on the first outer wall 14*a* is closed by the outer clamping piece 62 of the first lid body 60*a*. Similarly, the second outer recess 17*b* formed on the second outer wall 14*b* of the case 11 is also closed by the outer clamping piece 62 of the second lid body 60*b*.

As illustrated in FIG. 5, if the first lid body 60*a* is mounted on the opening of the first storage chamber S1, the inner surface of the first lid body 60*a* causes a pair of elastic support pieces 57 and 57 of the spring member 55 to be pressed downward and deformed. The elastic pressing piece 56 of the spring member 55 causes the first switching member 40*a* to be biased downward, and the drive portion 44*a* is compressed into the movable contact 35.

As illustrated in FIG. 5, in an initial state where operation force is not applied to the operation portion 51*a*, a lower portion of the drive portion 44*a* of the first switching member 40*a* is positioned at the further right side in FIG. 5 than the ride-on portion 35*c* of the movable contact 35, inside the first storage chamber S1. A contact point P1 between the drive portion 44*a* and the movable contact 35 is positioned at the further right side in FIG. 5 than the case center line O0.

As illustrated in FIG. 5, the spring regulating portion 25*a* formed in the case 11 opposes, from below, the left side (in FIG. 5) of the spring member 55, and the spring regulating portion 27*a* also opposes, from below, the right side (in FIG. 5) of the spring member 55. The spring member 55 is freely stored inside the first storage chamber S1. However, since the spring regulating portions 25*a* and 27*a* oppose the spring member 55 at both sides, there is no possibility that the posture of the spring member 55 may fall down to an extreme degree.

As illustrated in FIG. 5, the contact point P1 between the drive portion 44*a* and the movable contact 35 is positioned by being deviated to the further right side (in FIG. 5) than the case center line O0. However, the spring regulating portion 25*a* opposes, from below, the spring member 55 at the further left side (in FIG. 5) than the case center line O0. Accordingly, the spring member 55 does not fall down in a counter-clockwise direction inside the first storage chamber S1. Thus, it is possible to always stably apply downward biasing force to the drive portion 44*a*.

In the second storage chamber S2, the contact point P1 between the drive portion 44*b* and the movable contact 35 is positioned by being deviated to a side close to the side wall 15*a* at the further left side (in FIG. 5) than the case center line O0, and the spring regulating portion 25*b* opposes the lower side of the spring member 55 at the side wall 15*b* side.

FIG. 9 is a cross-sectional view taken along line VII-VII in FIG. 2, which illustrates a state where the first lid body 60*a* is mounted on the case 11. FIG. 9 illustrates a combined structure of the first inner wall 13*a* of the case 11 and the inner clamping piece 61 of the first lid body 60*a*, sequentially from the operation space S3 side.

As illustrated in FIG. 9, if the inner clamping piece 61 of the first lid body 60*a* is mounted on the outer surface facing the operation space S3 of the first inner wall 13*a* of the case 11, a penetrating portion 65 surrounded with the first inner recess 16*a* formed on the first inner wall 13*a* and the first cutout portion 61*a* formed in the inner clamping piece 61 is formed. As illustrated in FIG. 4, if the first switching member 40*a* is mounted on the case 11, the base support portion 42*a* is positioned inside the penetrating portion 65.

The penetrating portion 65 is opened, having a limited opening area surrounded with the first inner recess 16*a* and the first cutout portion 61*a*. Accordingly, it is possible to minimize a gap between the penetrating portion 65 and the base support portion 42*a*, and thus, it is possible to reduce a probability that dust, dirt or the like may enter the first storage chamber S1 from the operation space S3.

As illustrated in FIG. 9, the second cutout portion 61*b* of the inner clamping piece 61 opposes the second auxiliary recess 18*b* formed on the first inner wall 13*a*. The auxiliary support portion 43*b* (not illustrated) of the second switching member 40*b* is moved inside a space surrounded with the second auxiliary recess 18*b* and the second cutout portion 61*b*.

A relationship described above is also the same as a relationship of the second inner recess 16*b* and the first auxiliary recess 18*a* which are formed on the second inner wall 13*b*, and the first cutout portion 61*a* and the second cutout portion 61*b* which are formed in the inner clamping piece 61 of the second lid body 60*b*.

Figure 8:
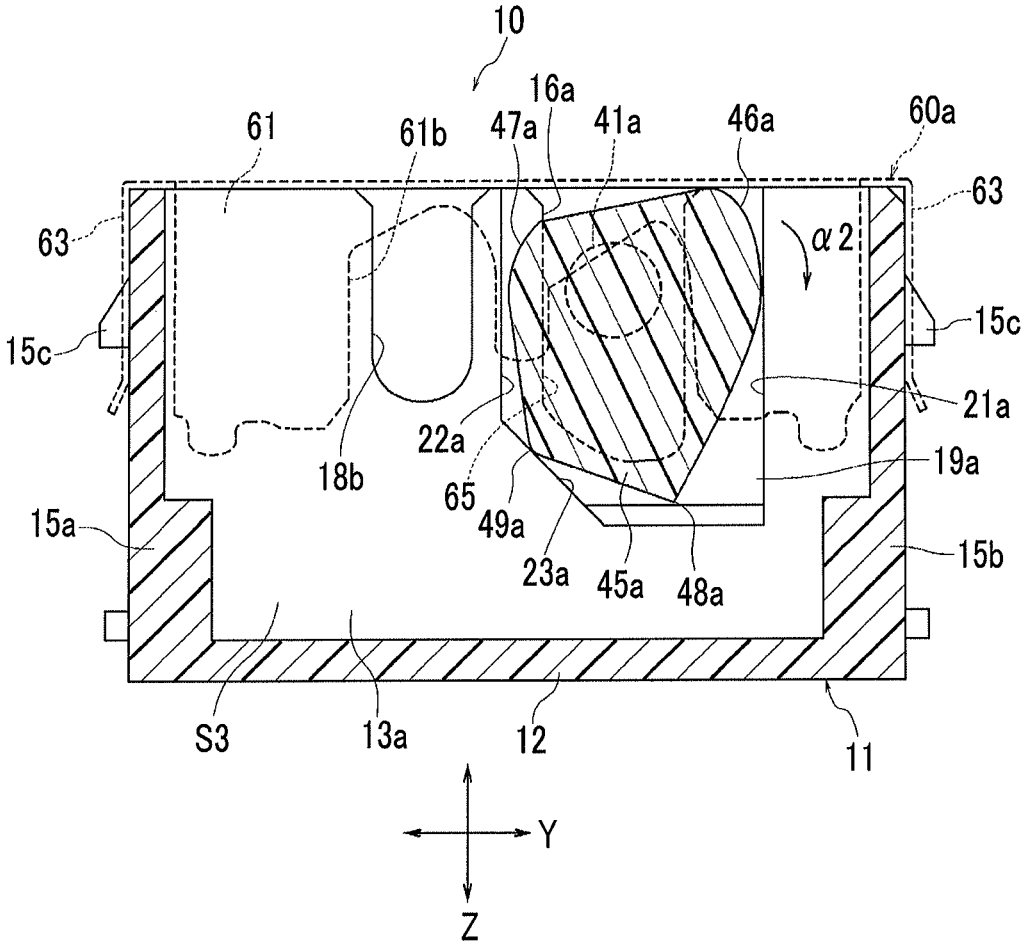
FIG. 8 is an operation diagram in a cross-sectional view which is the same as that of FIG. 7.

As illustrated in FIGS. 7 and 8, if the first switching member 40*a* is mounted on the case 11, the flange portion 45*a* of the first switching member 40*a* is inserted into the first wall surface dent 19*a* formed on the first inner wall 13*a*. If the first lid body 60*a* is further mounted thereon, as illustrated in FIG. 4, the inner clamping piece 61 is overlapped with the flange portion 45*a* of the first switching member 40*a* from the operation space S3. The flange portion 45*a* is interposed between the inner wall of the first wall surface dent 19*a* and the inner clamping piece 61.

The flange portion 45*a* has an area larger than the opening area of the penetrating portion 65. Accordingly, as illustrated in FIGS. 7 and 8, the flange portion 45*a* closes a gap between the first inner recess 16*a* and the base support portion 42*a*. In this manner, it is possible to prevent the first storage chamber S1 and the operation space S3 from directly communicating with each other. Furthermore, as illustrated in FIG. 4, the inner clamping piece 61, the flange portion 45*a* and the first inner wall 13*a* are in a threefold overlapped state with one another between the operation space S3 and the first storage chamber S1. Therefore, it is possible to effectively block dust, dirt or moistures into so as not to enter the first storage chamber S1 from the operation space S3.

As illustrated in FIGS. 7 and 8, if the flange portion 45*a* is positioned inside the first wall surface dent 19*a*, the convexly curved surface portion 46*a* and the pivotal movement regulating portion 48*a* of the edge outer surface of the flange portion 45*a* oppose the vertical edge inner surface 21*a* of the first wall surface dent 19*a*. In addition, the convexly curved surface portion 47*a* opposes the vertical edge inner surface 22*a*, and the pivotal movement regulating portion 49*a* opposes the inclination edge inner surface 23*a*.

The second switching member 40*b* is also similarly mounted on the case 11. A positional relationship between the flange portion 45*b* of the second switching member 40*b* and the inner support piece 61 of the second inner wall 13*b* and the second lid body 60*b* is symmetrical to those illustrated in FIGS. 7, 8 and 9.

If the first switching member 40*a* and the second switching member 40*b* are mounted on the case 11, the operation portion 51*a* of the first switching member 40*a* and the operation portion 51*b* of the second switching member 40*b* are positioned together inside the operation space S3. As illustrated in FIG. 2, the operation portion 51*a* of the first switching member 40*a* and the operation portion 51*b* of the second switching member 40*b* are positioned side by side in the lateral direction (Y direction) inside the operation space S3.

As illustrated in FIG. 1, in the electric equipment such as the vehicle power window device, the case 11 of the switching device 10 is fixed to a base 2. The common fixed contacts 31*a* and 31*b*, the initial contact fixed contacts 32*a* and 32*b*, and the switching fixed contacts 33*a* and 33*b* are soldered onto and connected to a circuit pattern on the base 2.

The operation member 1 is supported by a support shaft 3 so as to be pivotally movable. A switching and pressing portion 4 is formed integrally with the lower portion of the operation member 1. The switching and pressing portion 4 is interposed between the operation portion 51*a* of the first switching member 40*a* and the operation portion 51*b* of the second switching member 40*b*.

When the operation member 1 adopts a posture illustrated by a solid line in FIG. 1, as illustrated in FIG. 5, the first switching member 40*a* adopts an initial posture in the first storage chamber S1 of the case 11, the contact point P1 between the drive portion 44*a* and the movable contact 35 is positioned at the further right side (in FIG. 5) than the ride-on portion 35*c* of the movable contact 35, and the initial contact piece 35*a* of the movable contact 35 is in contact with a first initial contact fixed contact 32*a*. In the second storage chamber S2, a contact point between the drive portion 44*b* and the movable contact 35 of the second switching member 40*b* which adopts the initial posture is positioned at a side closer to the side wall 15*a* than the ride-on portion 35*c* of the movable contact 35, and the initial contact piece 35*a* of the movable contact 35 is in contact with a second initial contact fixed contact 32*b*.

When the first switching member 40*a* adopts the initial posture, as illustrated in FIG. 7, the flange portion 45*a* of the first switching member 40*a* is in a neutral position inside the first wall surface dent 19*a* formed on the first inner wall 13*a*. If the first switching member 40*a* is further pivotally moved in the counter-clockwise direction from the initial posture illustrated in FIG. 7, the pivotal movement regulating portion 48*a* of the flange portion 45*a* comes into contact with the vertical edge inner surface 21*a* of the first wall surface dent 19*a*. Accordingly, inadvertent pivotal movement of the first switching member 40*a* from the initial posture in the counter-clockwise direction is regulated. This is also the same when the second switching member 40*b* adopts the initial posture.

Figure 6:
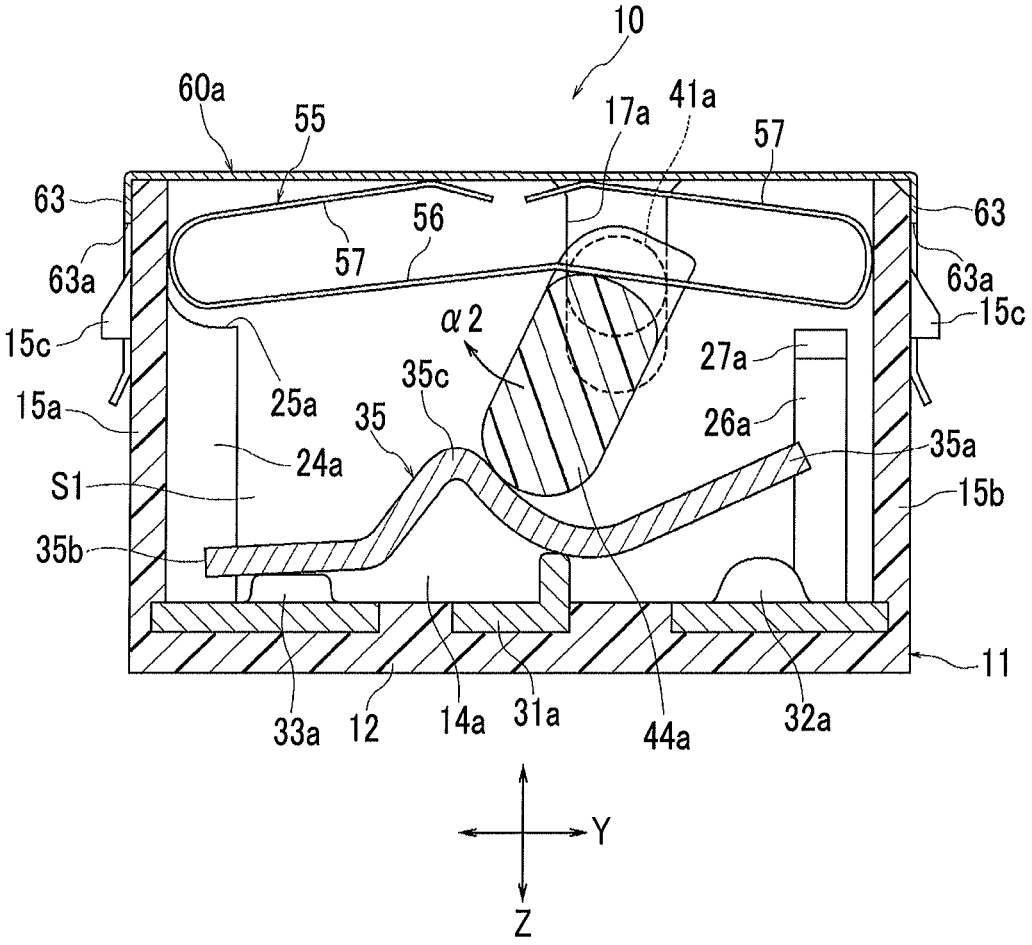
FIG. 6 is an operation diagram in a cross-sectional view which is the same as that of FIG. 5.

If the operation member 1 is tilted in a direction of al in FIG. 1, the operation portion 51*a* is pressed in a direction of $\alpha 2$ as illustrated by a broken line in FIG. 1, the first switching member 40*a* is pivotally moved in a clockwise direction (direction of $\alpha 2$). As illustrated in FIG. 6, the drive portion 44*a* rides on the ride-on portion 35*c* of the movable contact 35, the movable contact 35 is pivotally moved about a fulcrum of the first common fixed contact 31*a* in the counter-clockwise direction, and the switching contact piece 35*b* of the movable contact 35 is brought into contact with the first switching fixed contact 33*a*.

In this case, in order for the drive portion 44*a* to ride on the ride-on portion 35*c* while being pivotally moved in the direction of α2, the first switching member 40*a* is pivotally moved in the clockwise direction and is entirely lifted up a little. As a result, the elastic pressing piece 56 of the spring member 55 deflects to apply restoring force from the elastic pressing piece 56 to the drive portion 44*a*. If the operating force applied to the operation member 1 is released, the elastic force of the spring member 55 causes the drive portion 44*a* to be restored as illustrated in FIG. 5, and causes the first switching member 40*a* to restore the initial posture.

In FIG. 1, if the operation member 1 is tilted in the clockwise direction (direction of β1), the operation portion 51*b* is pressed, and the second switching member 40*b* is pivotally moved in a direction of β2. In the second storage chamber S2, the switching contact piece 35*b* of the movable contact 35 is brought into contact with the second switching fixed contact 33*b*.

As illustrated in FIG. 6, if the first switching member 40*a* is pivotally moved in the direction of α2, as illustrated in FIG. 8, the flange portion 45*a* is pivotally moved inside the first wall surface dent 19*a* in the direction of α2. The convexly curved surface portion 46*a* of the flange portion 45*a* slides on the vertical edge inner surface 21*a* of the first wall surface dent 19*a*, and the convexly curved surface portion 47*a* slides on the vertical edge inner surface 22*a*. In this manner, the flange portion 45*a* can be pivotally moved without receiving great resistance inside the first wall surface dent 19*a*.

If the flange portion 45*a* is pivotally moved in the direction of α2, the pivotal movement regulating portion 49*a* of the flange portion 45*a* comes into contact with the inclination edge inner surface 23*a*. This regulates the further pivotal movement of the first switching member 40*a* in the direction of α2. It is possible to regulate a pivotal movement angle of the first switching member 40*a* by disposing the pivotal movement regulating portions 48*a* and 49*a* in the flange portion 45*a*. Therefore, it is possible to prevent the pivotal movement at an excessive angle.

As illustrated in FIGS. 5, 6, 7 and 8, the first switching member 40*a* is vertically moved while being pivotally moved. Accordingly, it is necessary to dispose a gap for the vertical movement between the penetrating portion 65 illustrated in FIG. 9 and the base support portion 42*a* of the first switching member 40*a*. However, since the flange portion 45*a* can close the gap, it is possible to close the gap between the first storage chamber S1 and the operation space S3. Therefore, dust, dirt or moistures are unlikely to enter the first storage chamber S1.

This is also the same in the case of the second storage chamber S2.

It should be understood by those skilled in the art that various modifications, combinations, sub-combinations and alterations may occur depending on design requirements and other factors insofar as they are within the scope of the appended claims of the equivalents thereof.

What is claimed is:

1. A switching device comprising:

a case for storing a fixed contact, a movable contact selectively coming into contact with the fixed contact and a switching member operating the movable contact; and a lid body that closes the case, wherein the case is formed to integrally have two inner walls erecting from a bottom and opposing each other, two outer walls opposing an outside of the respective inner walls and erecting from the bottom, and a side wall connecting both ends of the respective inner walls and the respective outer walls and erecting from the bottom, wherein the case is configured to have two storage chambers having an upper opening by being surrounded with the inner walls, the outer walls, the side wall and the bottom, and an operation space positioned between two inner walls, and each of the storage chambers stores the fixed contact and the movable contact, wherein each of the storage chambers has an inner recess, which is exposed upward by penetrating the inner wall, wherein each of the switching members has a tip support portion supported by the outer wall, a base support portion supported by the inner recess, a drive portion positioned inside the storage chamber and operating the movable contact, and an operation portion formed integrally with the base support portion and moving inside the operation space, and wherein each of the switching members has a flange portion between the base support portion and the operation portion, wherein each of the storage chambers stores a spring member pressing the drive portion against the movable contact and biasing the operation portion so as to return to an initial posture, and wherein the lid body is separated into two, and the opening of the storage chamber is closed by each of the lid bodies, the lid body has clamping pieces overlapped with each other on an outer surface facing the operation space of the inner wall, and the switching member is positioned in a cutout portion formed in the clamping piece, and the flange portion closes a penetrating portion formed between the inner recess and the cutout portion.

2. The switching device according to claim 1, wherein a wall surface dent is formed at both side portions of the inner recess on the outer surface facing the operation surface of the inner wall, and the flange portion is positioned between the wall surface dent and the clamping piece for covering the wall surface dent.

3. The switching device according to claim 2, wherein when the switching member is operated, the base support portion is pivotally moved and vertically moved inside the inner recess.

4. The switching device according to claim 2, wherein a convexly curved surface portion is formed on an edge outer surface of the flange portion, and when the switching member is pivotally moved, the convexly curved surface portion slides on an edge inner surface of the wall surface dent.

5. The switching device according to claim 4, wherein a pivotal movement regulating portion for regulating a pivotal movement angle of the respective switching members by the coming into contact with edge inner surface is disposed on the edge outer surface.

6. The switching device according to claim 1, wherein the spring member is formed to have a leaf spring material, and is configured so that an elastic pressing piece positioned inside the storage chamber is formed integrally with an elastic support piece which is bent upward from both end portions of the elastic pressing piece and which comes into contact with an inner surface of the lid body, and wherein the elastic pressing piece is configured so that a portion separate from a central portion thereof to one side is elastically pressed against the drive portion of the switching member, and a spring regulating portion which opposes, from below, a portion separate from the central portion of the elastic pressing piece to the other side is disposed inside the storage chamber.

* * * * *